United States Patent [19]

Hauri et al.

[11] 3,976,246

[45] Aug. 24, 1976

[54] EVAPORATOR-BLOCK CONTAINER WITH ADJUSTABLE CROSS SECTION OF OUTLET APERTURE

[75] Inventors: Rene Hauri, Frenkendorf; Raphael Charles Misslin, Basel, both of Switzerland

[73] Assignee: Ciba-Geigy AG, Basel, Switzerland

[22] Filed: May 8, 1975

[21] Appl. No.: 575,680

[30] Foreign Application Priority Data

May 15, 1974 Switzerland ..... 6646/74

[52] U.S. Cl. ..... 239/57; 239/58; 239/60

[51] Int. Cl.[2] ..... A24F 25/00

[58] Field of Search ..... 239/53–60

[56] References Cited

UNITED STATES PATENTS

| | | | |
|---|---|---|---|
| 2,642,310 | 6/1953 | Meek et al. | 239/59 X |
| 3,104,816 | 9/1963 | Jaffe | 239/60 X |
| 3,754,707 | 8/1973 | Morane | 239/59 |

*Primary Examiner*—John J. Love

*Attorney, Agent, or Firm*—Harry Falber; Karl F. Jorda

[57] ABSTRACT

Evaporator-block container having an adjustable cross section of the outlet aperture and comprising two housing components of which the one is a retaining part suitable for holding an evaporator block, the said retaining part having at least one outlet aperture for the outlet of vapors of an active substance contained in the evaporator block, and the other is a sealing part which seals or closes in an adjustable manner, either completely or partially, the outlet aperture(s) and which is connected with the retaining part in the closed position to give a sealed but releasable closure, characterized in that there is incorporated inside the housing parts a mould having an inlet aperture facing the sealing part, which is for the pouring in of evaoporator-block material in the melted state.

8 Claims, 7 Drawing Figures

22'
10'
18'
51'
21'
18'
18'
17'
43'
16'
12'
23'
42'
23'a
50'
50'
40'
52'

EVAPORATOR-BLOCK CONTAINER WITH ADJUSTABLE CROSS SECTION OF OUTLET APERTURE

The invention relates to an evaporator-block container having an adjustable cross section of the outlet aperture and comprising two housing components of which the one is a retaining part suitable for holding an evaporator block, the said retaining part having at least one outlet aperture for the outlet of vapours of an active substance contained in the evaporator block, and the other is a sealing or closing component which seals or closes in an adjustable manner, either completely or partially, the outlet aperture and which is connected with the retaining part in the closed position to give a sealed but releasable closure.

The commercially available evaporator-block containers of the above-described type suffer from a number of disadvantages. For instance, the evaporator block when produced usually has to be inserted, by hand or by machine, into the opened container, and this then has to be hermetically sealed. The hermetic seal normally provided for storage has moreover to be destroyed before use. Finally, the adjustment to give various intensities of emission of active-substance vapours from the evaporator block is uncertain or insecure and/or the sealing component is not securely connected to the retaining component so that the former can fall off and become lost.

The object of the present invention is therefore the provision of an evaporator-block container of the initially described type which, however, does not have the aforementioned disadvantages, which is of light construction and manufacturable from a small number of components, and which can be produced, in particular, from plastics, e.g., from polyethylene or polypropylene, in the injection moulding process by means of simple moulds.

This object is attained by there being provided an evaporator-block container of the type initially described, the evaporator-block container of the present invention being however characterised in that there is incorporated inside the housing components a mould for the pouring-in of evaporation-block material in the molten state, the inlet aperture of the said mould being situated facing the sealing component.

Retaining component and sealing component can contain casing elements which in the closed or sealed position are mated together to effect a complete sealing off of the interior of the mould from the outside atmosphere; and there is preferably provided an adjusting device by means of which the two casing elements can be held apart at at least one specific distance, so that the interior of the mould is thus open to the outside atmosphere by way of the opening between the two casing elements. The adjusting arrangement comprises preferably engaging elements by means of which the two casing components can be maintained in the sealed position.

The mould advantageously has a bottom surface as well as one wall which is secured on the inside of the one housing component, on or at the bottom surface, and a second wall which is secured on the inside of the other housing component and which in the sealed position is connected with the bottom surface to give a sealed but releasable closure.

The two wall sections are preferably designed as annular walls arranged coaxially with respect to each other.

The wall section secured on the bottom surface can be fixed in the retaining part to form the outer annular wall of the mould, and the other wall section can be fixed in the sealing part to form the inner annular wall arranged coaxially with respect to the outer annular wall.

On the bottom surface of the mould there is advantageously located at least one guide member, by means of which the second wall section is positioned. In this connection, the aforementioned engaging system can comprise one engaging element on the guide member and a second engaging element, capable of engaging with the first one, on the second wall section of the mould which is positioned by the guide member.

The one of the two wall sections forming the mould can in addition have on its unsecured peripheral edge at least one releasing element, and the housing part against the inner surface of which this wall section is located in a sealed but releasable manner can have a second releasing element operating in conjunction with the first, so that by rotating the one housing part with respect to the other the first and the second releasing element(s) function together in such a way that a disengaging of the two engaging elements on the guide member and on the second wall section, respectively, occurs, so that an adjustment of the two housing parts at a distance from each other is rendered possible.

In the sealing part there is advantageously provided at least one opening through which, with the container closed, block material can be poured in the molten state through the opening of the mould located below.

There is preferably provided a seal, particularly in the form of a sheet impervious to vapours from the active substance contained in the block material, for sealing off the opening(s) of the sealing part after the block material has been poured in.

Further details of the invention are described in the following and/or are illustrated by the drawings in which FIG. 1 is a cross section through a preferred embodiment of the evaporator-block container, in the closed position;

Figure 1:
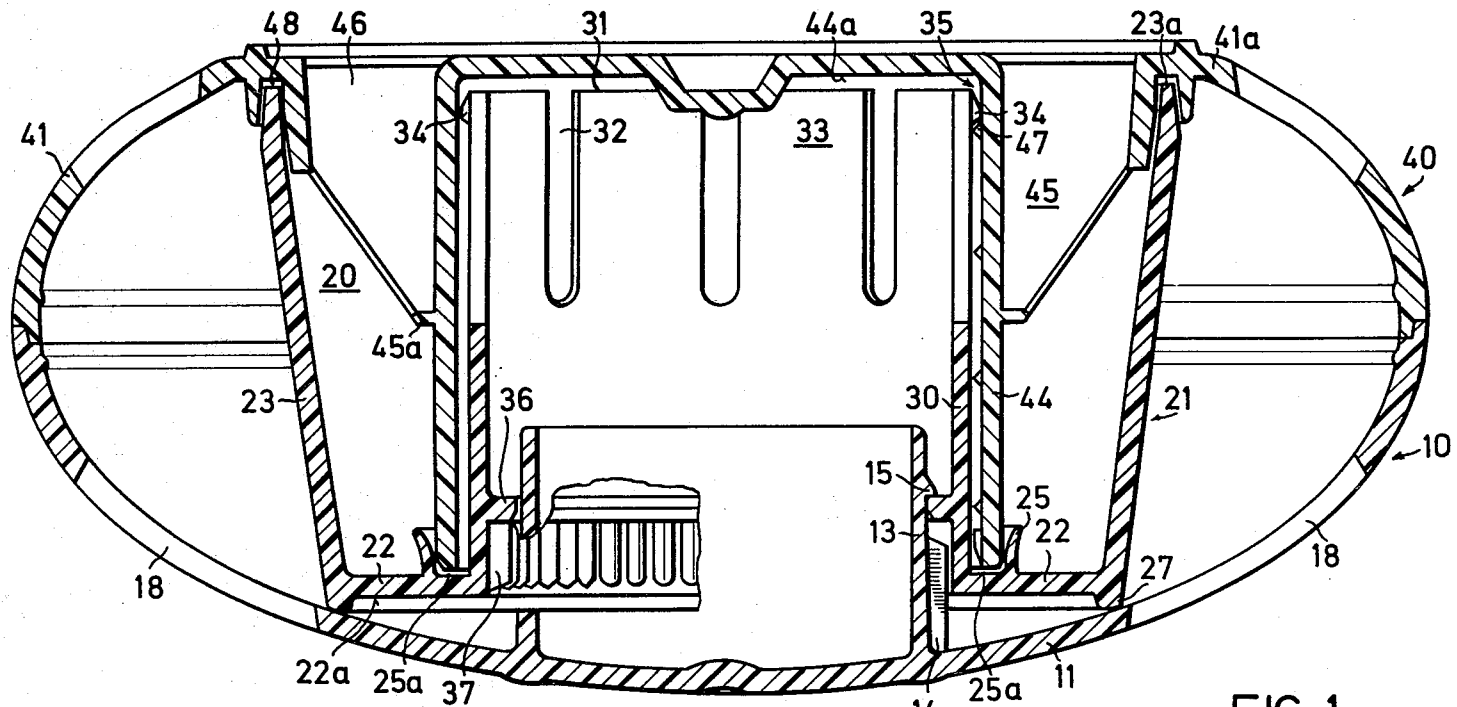

The embodiment illustrated in the drawing of an evaporator-block container according to the invention comprises two housing parts: a retaining part 10 and a sealing part 40. The retaining part 10 consists of a flat, dome-shaped casing or shell of circular form having a centrally arranged supporting socket 13 (FIG. 5) formed as one piece with the casing 11 and projecting up, on the inside of the casing 11, in the casing opening 12, which is facing the sealing part 40, and the part 21 of a mould 20 (FIG. 4) having a pouring-in opening 20*a*, the said part 21 being formed from a bottom surface 22 and an outer annular wall 23 which surrounds this bottom surface and opens out conically towards the top.

The supporting socket 13 is cylindrical in shape and carries on its outer face guide ribs 14 extending in an axial direction, as well as an engaging lug 15 extending in a radial plane with respect to the axis of the cylinder. A shoulder 17 extends around the peripheral edge 16 of the casing opening 12, and in the side wall of the casing 11 there are provided a number of radially extending slots 18.

Figure 4:
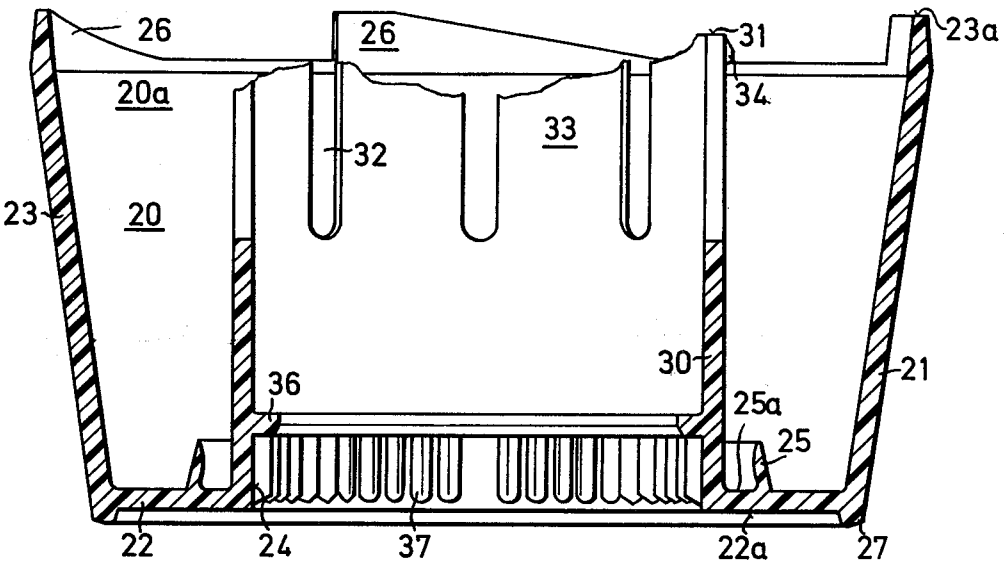
FIGS. 4 and 5 show in cross section a mould and a housing part which together form the housing component according to FIG. 3.
Figure 5:
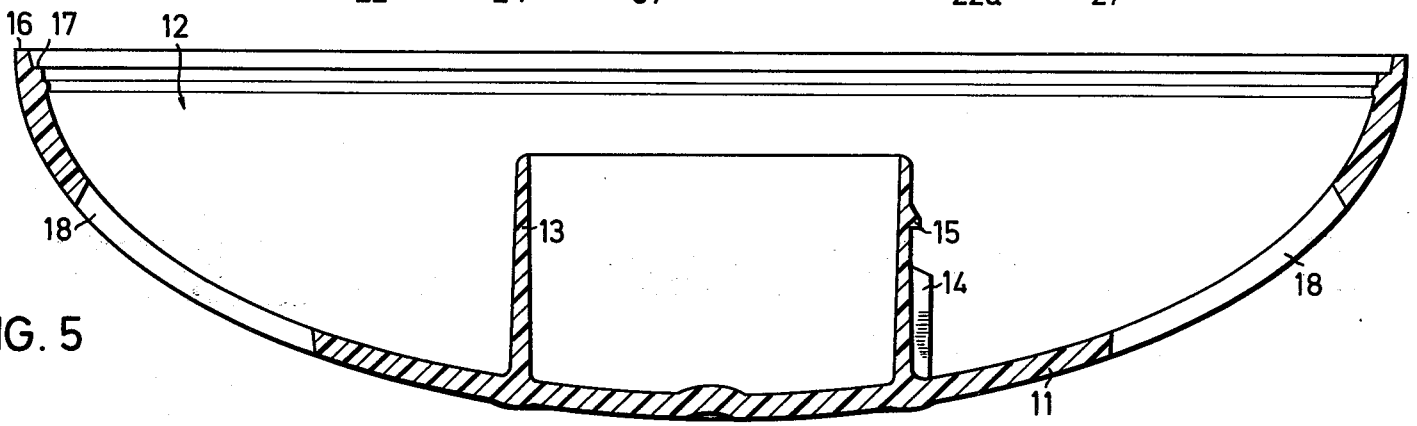

The mould component 21 shown in FIG. 4 separate from the retaining part 10 has, in addition to its circular bottom surface 22 and the annular wall 23 commencing at the periphery of the bottom surface, a guide bush 30 of cylindrical form surrounding a central opening 24 in the bottom surface 22, which guide bush, arranged coaxially to the annular wall 23, forms a guide member for the mould inner wall 44 described below. The guide bush 30 is encircled, at a short distance from its base, by a circular sealing and centering ledge or projection 25 projecting up from the bottom surface 22, which projecting edge, with construction of the entire mould part 21 from thermoplastic, elastically slightly giving material and suitable tapering of its cross section towards its outer edge, is of a somewhat flexible nature. There is thus formed an annular groove 25*a* between the annular ledge 25 and the guide bush 30.

The outer annular wall 23 of the mould part 21 is provided on its peripheral edge 23*a* with lifting lugs 26 which act as releasing elements for the release of the two housing parts 10 and 40 from the interlocked state in the sealed position, as illustrated below.

The guide bush 30 has on its free edge facing the inside of the housing a number of elongated slots 32, as a result of which its upper part formed by the tongue elements 33 situated between the slots 32 can give elastically inwards to some degree. On the outside of the tongue elements 33 of the bush 30 there are situated, near to the free ends of the tongue elements, transverse edges or ribs 34 as part of an adjusting arrangement 35, the function of which is likewise described in the following.

On the inside wall of the bush 30 there is located, somewhat above the level of the bottom surface 22, an annular flange 36, and below this the inside surface of the bush carries axial guide fins 37. The mould part 21 is slipped onto the supporting socket 13 so that the latter projects through the central opening 24 in the bottom surface 22 of the mould 20, and its guide ribs 14 take up position between the guide fins 37 in the base part of the mould 20. At the same time, a supporting edge 27 encircling the bottom surface 22 on its underside 22a rests on the inside of the casing 11 centrally with respect to the ring of slots 18 in the casing. When the mould part 21 is placed onto the base of the inside of the casing 11, the annular flange 36 snaps into position under the engaging lug 15, and the interlocked ribs 14 and 37 prevent a rotating of mould part 21 with respect to casing 11.

The sealing part 40 is then placed onto the retaining part 10 now fully assembled.

This sealing part consists of the casing side wall 41 of which the opening facing the retaining part 10 is of the same diameter as the casing opening 12 of the retaining part 10, and which therefore fits exactly, with its annular ledge 43 provided on the peripheral edge 42, onto the shoulder 17 of the peripheral edge 16 of the retaining part 10, and of the cylindrical wall part 44, formed as one piece with the casing wall 41 on the inside thereof, which serves as the inside annular wall of the mould 20. Wall part 44 is attached by means of a number of connecting ribs 45 firmly and centrally to the casing side wall 41, with apertures 46 being left between the ribs 45. On the inside wall of the wall part 44 there are provided, at varying distances from the case bottom 44*a*, transverse ribs 47, 47*a*, 47*b* and 47*c* as engaging elements of the adjusting arrangement 35, of which ribs those situated at the appropriate height, e.g., at $d_1$, $d_2$, $d_3$ or $d_4$, rest, when the container is open, on the transverse ribs 34 on the outer wall of the guide bush 30.

Figure 6:
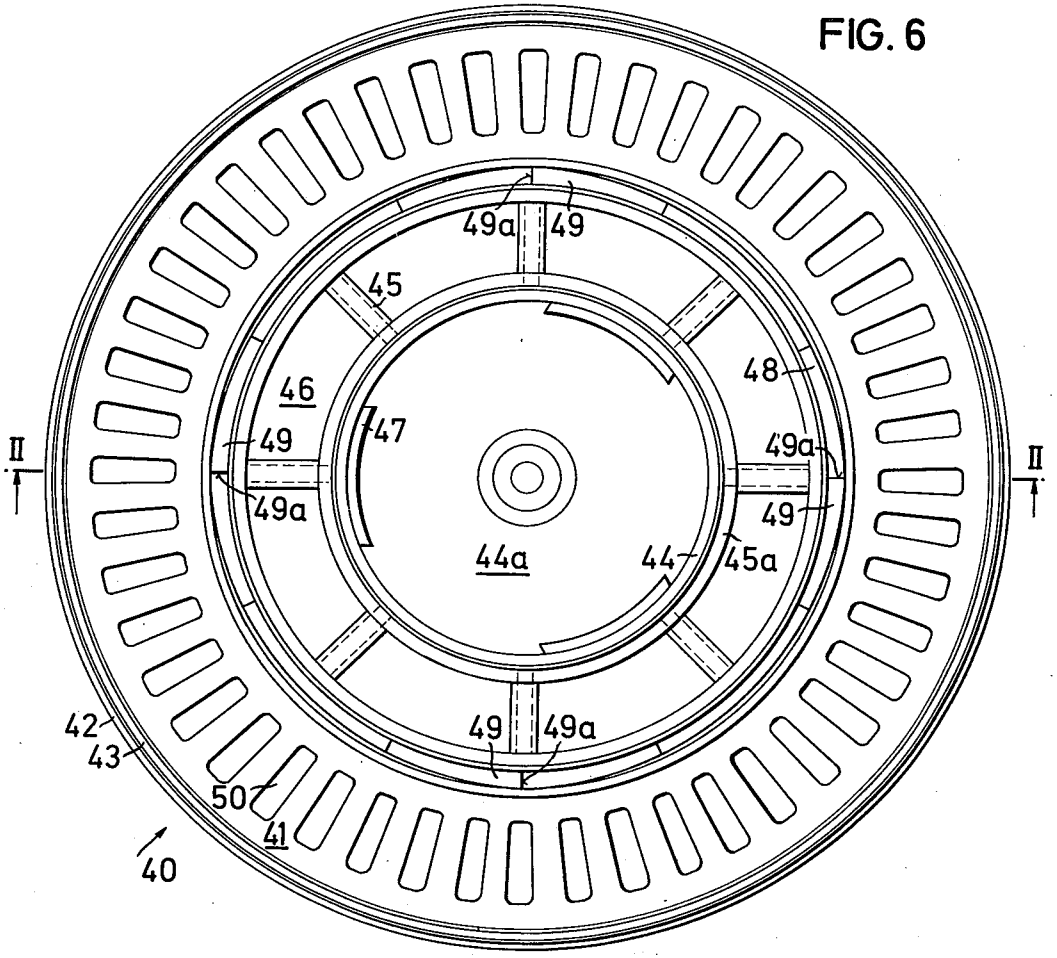
FIG. 6 is a view of the inside of the housing component serving as the sealing part of the embodiment according to FIGS. 1 and 2.

In an annular groove 48 on the bottom part 41*a* of the casing side wall 41 of the sealing part 40, there are provided run-up ramps 49 with stops 49*a* (FIG. 6), against which the lifting lugs 26 on the outer wall part 23 of the mould 20 are locked when the housing part 10 is rotated clockwise with respect to housing part 40, whereas the lifting lugs 26 run up the ramps 49, and thus release the two housing parts 10 and 40 from their locked position, when the housing part 10 is rotated anticlockwise with respect to the housing part 40.

Radially extending slots 50 similar to those in the retaining part 10 are also provided in the casing side wall 41.

The assembly of the evaporator-block container from the housing parts 10 and 40 and the introduction of an evaporator block are carried out in the following manner.

The sealing part 40 is firstly fitted onto the retaining part 10, with the peripheral edge 42 of the sealing part 40 sitting, in the sealed position as shown in FIG. 1, on the peripheral edge 16 of the retaining part 10. At the same time, however, the inner annular wall 44 of the mould 20 is inserted, with its free end in this position facing downwards, into the annular groove 25*a*, whereupon the annular sealing and centering ledge 25 is bent to some degree outwards to seal against the inner wall 44 of the mould. The transverse rib 47 that is furthest inside on the inside face of the wall part 44 has meanwhile slid under the transverse ribs 34 on the tongue elements 33 of the guide bush 30, and is firmly held at the transverse ribs 34. By clockwise rotation of the one housing part with respect to the other, the lifting lugs 26 are brought up against the stops 49*a* in the annular groove 48 in the sealing part 40. The two housing parts 10 and 40 are now locked together in the sealed position.

Figure 2:
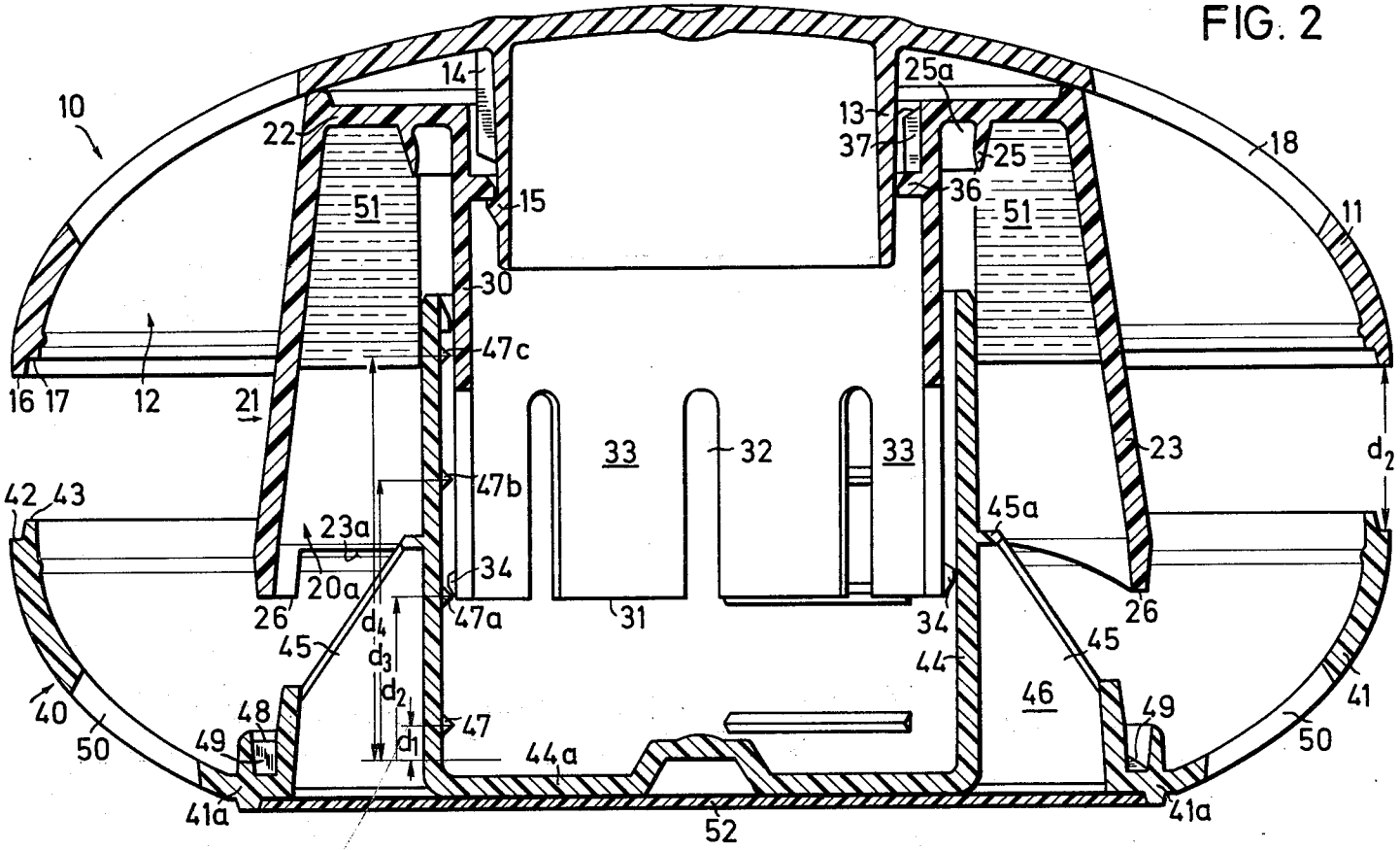
FIG. 2 is a cross section through the same embodiment in the open position.
Figure 3:
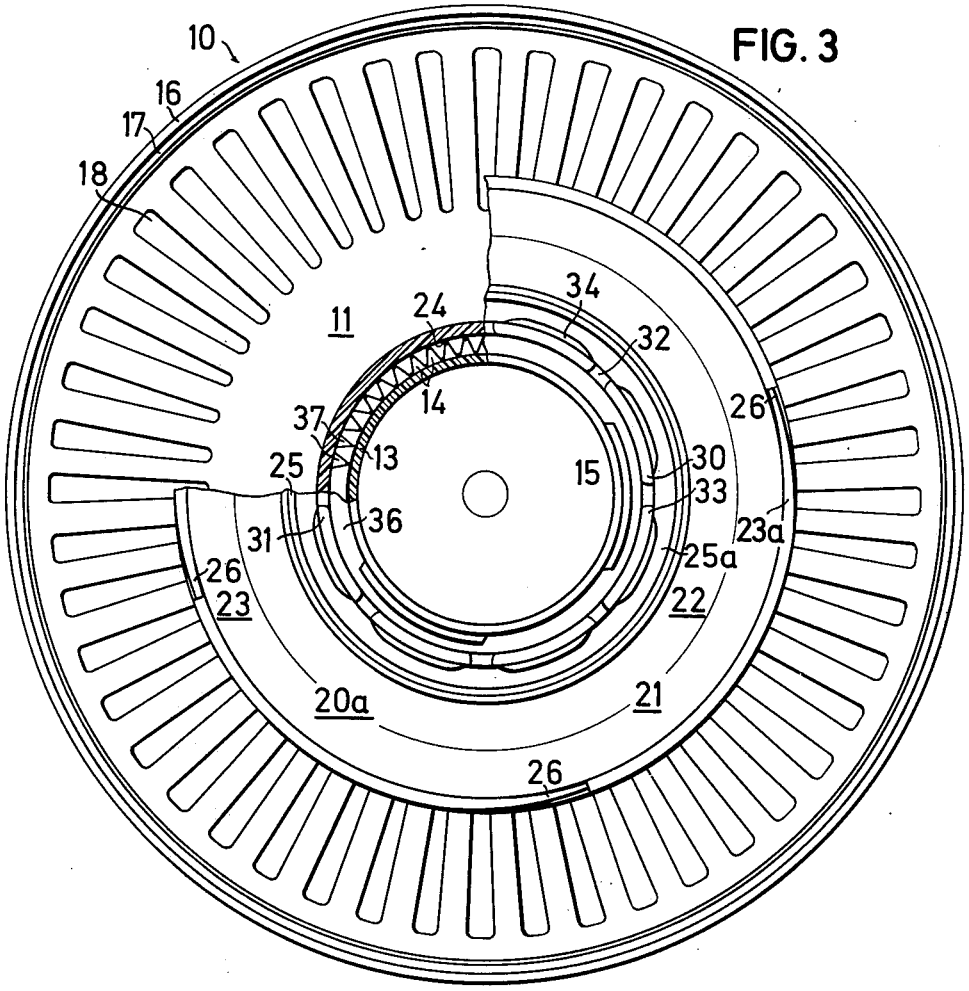
FIG. 3 is a view of the inside of the housing component serving as the retaining part of the embodiment according to FIGS. 1 and 2.

The mould 20 is now situated with its circular pouring-in opening 20*a* below the apertures 46 in the sealing part 40, and is accessible to the outside only by way of these apertures. Melted material containing an active substance, e.g., a deodorant, a volatile insecticide, a perfume and the like, is now poured through the apertures 46 into the mould 20, preferably only to the height of a union flange 45*a*, above which the connecting ribs 45 between the mould inner wall part 44 and the bottom part 41*a* of the casing side wall 41 of the sealing part 41 commence. On solidification of the melted material, there is formed inside the mould 20 an evaporator block 51 as indicated by dotted lines in FIG. 2. The apertures are then covered by a suitable sealing sheet 52, impervious to active-substance vapors from the evaporator block, as shown in FIG. 2. The resulting evaporator block hermetically sealed in its container can now be stored.

When being brought into use, the device is placed in position with the sealed bottom surface 41*a* of the sealing part downwards; by rotation of the retaining part 10 in anticlockwise direction, with the sealing part 40 being firmly held, the lifting lugs 26 are caused to move up the adjacent ramps 49 sloping up in anticlockwise direction, and consequently there is effected a release of the transverse rib 47 from the locking position under the transverse ribs 34 on the guide bush 30, so that the unlocked retaining part 10 can be raised, as shown in FIG. 2, until, e.g., the transverse ribs 34 on the guide bush 30 rest, as shown, on the transverse ribs 47*a* of the inner wall 44 of the mould, so that the retaining part 10 is held at a distance $d_2$ from the sealed position. The evaporating surface of the block in the mould 20 points downwards and thus the active-substance vapors, which are usually heavier than air, disperse readily through the annular space between the edges 16 and 42 of the two housing parts, now at a distance $d_2$ from each other, as well as through the slots 50 in the sealing part 40. In addition, the dispersion of the vapors is promoted by the air which can also circulate through the slots 18. If the active-substance vapors are however lighter than air, then they can easily escape through the slots 18, while air can circulate through the space between the housing parts and through the slots 50 in the sealing part 40. In every case, therefore, a rapid dispersion of the active-substance vapors in the space to be affected is ensured on application of the evaporator-block container of the invention.

Depending on the age of the block and hence on the amount of active-substance vapors still escaping, the container can be used with a larger or smaller space, i.e., $d_2$ to $d_4$, the adjustment being effected with the aid of the arrangement 35.

The fact that the evaporator block can be poured directly into the mould in the container offers a number of obvious advantages. For instance, the more complicated insertion of a finished solid block and the subsequent mounting of the sealing part are avoided. Furthermore, the removal of the seal, which is necessary in the case of all other devices of this kind, is rendered here unnecessary. A hermetic re-sealing of the block after a short period of use is better and more securely ensured with the container of the invention than with the known devices having windows and sliding shutter. The hermetic seal is effected in the case of the device according to the invention by three different features:

a. by the unremoved sealing sheet over the apertures of the sealing part;

b. by the pressing of the edge 23*a* of the outer mould wall 23 into the groove 48 and rotation clockwise until the lugs 26 make contact with the stops 49*a;* and c. by the sealing of the contact between the mould inner wall 44 and the mould bottom surface 22 by means of the flexible sealing edge 25.

Figure 7:
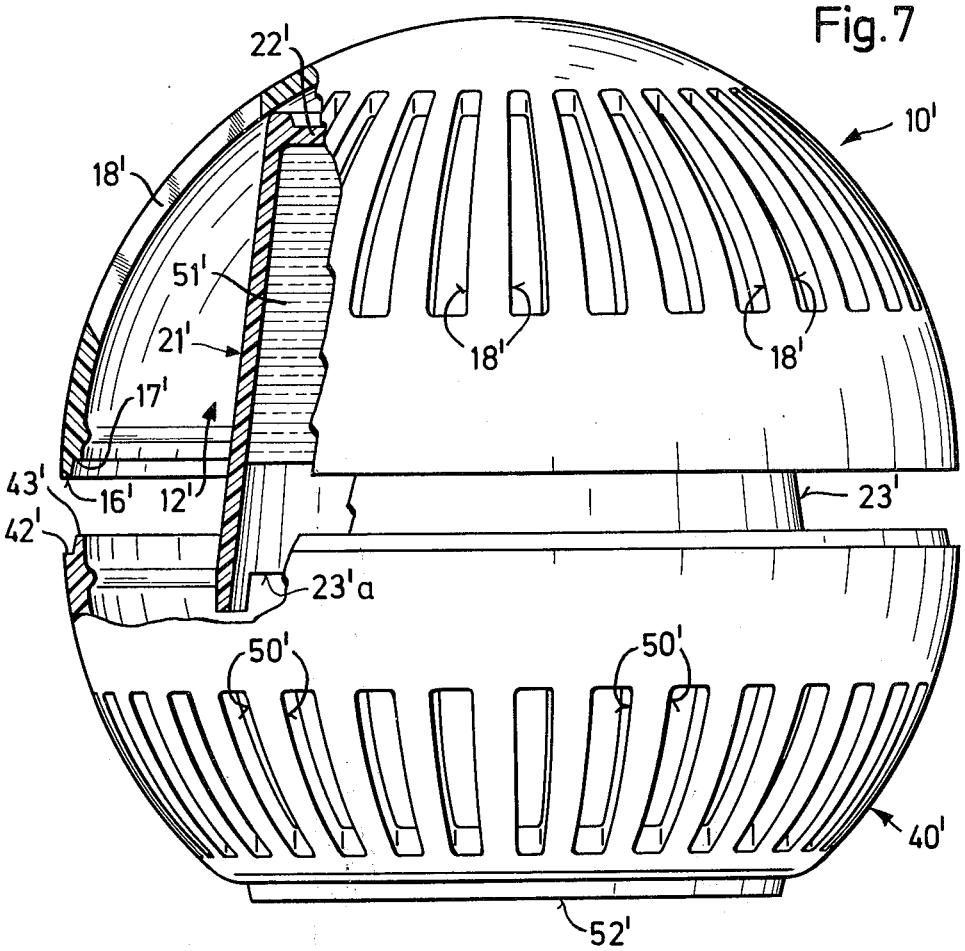
FIG. 7 is a view, partly in section, of another embodiment of the evaporator-block container of the instant invention.

The evaporator-block container described in the foregoing has, apart from its bottom surface, approximately the shape of a spheroid. It can however be designed also in the form of a rotational solid, e.g., in the form of a cylinder, a truncated cone or a sphere with flattened base (see FIG. 7).

We claim:

1. An evaporator-block container comprising two housing components of which the one is a retaining part suitable for holding an evaporator block, the said retaining part having at least one outlet aperture for the outlet of vapors of an active substance contained in the evaporator block, and the other is a sealing part which seals or closes in an adjustable manner, either completely or partially, said at least one outlet aperture and which is connected with the retaining part in the closed position to give a sealed but releasable closure;

a mould positioned in said housing parts having a bottom surface, a first wall part secured on the inside of one of said housing components on or at the bottom surface, a second wall part attached to the inside of the other of said housing components and which in a sealed position engages said bottom surface to provide a sealed but releasable closure, and an inlet aperture facing said other of said housing components for receiving molten evaporator-block material; and adjusting means positioned on said housing components for sealingly engaging said components so as to completely seal off the inside of the mould from contact with the outside atmosphere and, alternately, for retaining said components in a separated position at at least one specific distance from each other.

2. Evaporator-block container according to claim 1, wherein the two wall parts are designed as annular walls arranged coaxially to each other.

3. Evaporator-block container according to claim 2, wherein the wall part attached to the bottom surface is secured, as the outer annular wall of the mould, in the retaining part, and the other wall part is secured, as the inner annular wall arranged coaxially to the outer annular wall, in the sealing part.

4. Evaporator-block container according to claim 1, wherein there is mounted on the bottom surface of the mould at least one guide member, by means of which the second wall part is positioned.

5. Evaporator-block container according to claim 4, wherein the adjusting means comprises one engaging element on the guide member and a second engaging element, capable of engaging with the first element, on the second wall part of the mould, which wall part is positioned by the guide member.

6. Evaporator-block container according to claim 5, wherein the one wall part of the two forming the mould is provided on its unsecured peripheral edge with at least one releasing element, and the housing part, on the inside surface of which this wall part is located in the sealed position to give a sealed but releasable closure, is provided with at least one releasing element acting together with the first releasing element, so that by rotation of the one housing part with respect to the other, the first and the second releasing element operate together in such a way that a disengaging of the two engaging elements on the guide member and on the second wall part occurs and hence an adjustment of the two housing parts to give a distance apart from each other of ($d$) is rendered possible.

7. Evaporator-block container according to claim 1, wherein there is provided in the sealing part at least one aperture, through which, with closed container, block material is poured in the melted state into the inlet opening of the mould located below.

8. Evaporator-block container according to claim 7, wherein there is provided a removable seal in the form of a sheet that is impervious to vapors of the active substance contained in the block material, for the sealing of the aperture(s) of the sealing part after pouring in of the block material.

* * * * *